United States Patent [19]

Alaniz

[11] Patent Number: 4,586,198

[45] Date of Patent: May 6, 1986

[54] GARMENTS EMPLOYING SUPERIMPOSED, DIAGONALLY-ORIENTED PANELS WITH FOLDED-BACK END PORTIONS

[76] Inventor: Leonore Alaniz, 247 Eighth Ave., San Francisco, Calif. 94118

[21] Appl. No.: 585,998

[22] Filed: Mar. 5, 1984

[51] Int. Cl.[4] ..... A41D 1/22

[52] U.S. Cl. ..... 2/105; 2/74; 2/243 B

[58] Field of Search ..... 2/105, 74, 75, 76, 243 B, 2/106, 93, 175, 2.21

[56] References Cited

U.S. PATENT DOCUMENTS

| | | | |
|---|---|---|---|
| 2,953,790 | 9/1960 | Navick et al. | 2/105 |
| 3,704,469 | 12/1972 | Levy | 2/69 |
| 4,097,933 | 7/1978 | de Polo | 2/105 |
| 4,176,408 | 12/1979 | de Polo | 2/69 |

*Primary Examiner*—Doris L. Troutman

*Attorney, Agent, or Firm*—David Pressman

[57] ABSTRACT

A garment (30) formed from two rectangular elongated panels (32 and 34) of identical shape and dimensions. The panels are superimposed in a face-to-face manner at an angle. Their upper portions are folded so that the edge of each upper portion adjoins a part of the corresponding edge of the other panel, thereby to form triangularly-shaped sleeve portions (50 and 50'). The latter are turned over towards the adjacent edges (46 and 46') to form sleeve openings (38 and 38'). The lower portions of the panels are folded so that the inner edge of one of panels adjoins and is attached to the outer edge of the other panel on both sides of the panels. The formation of the garment is completed by attaching coincident inner edges of the overlapped portions of the panels to leave a neck opening. Various modifications are possible so that dress-type, blouse-type, or coat-type garments can be formed. The garment is attractive and economical to produce.

19 Claims, 18 Drawing Figures

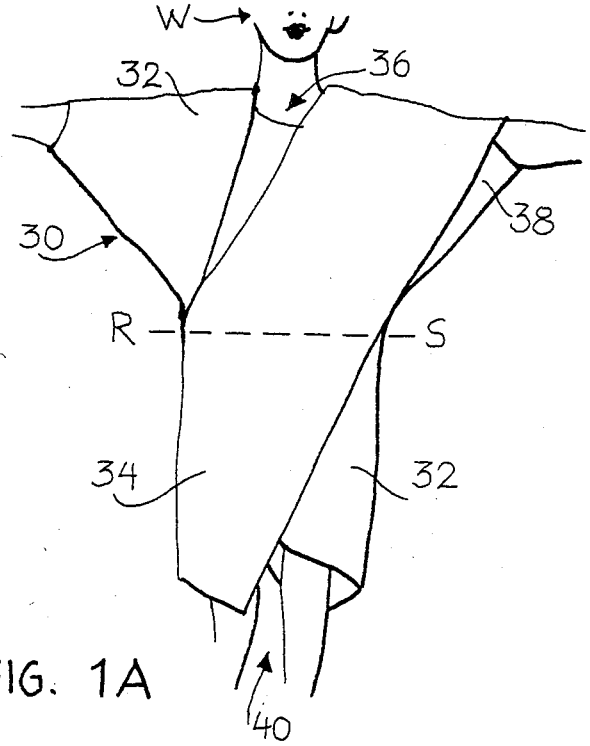
FIG. 1A
FIG. 2
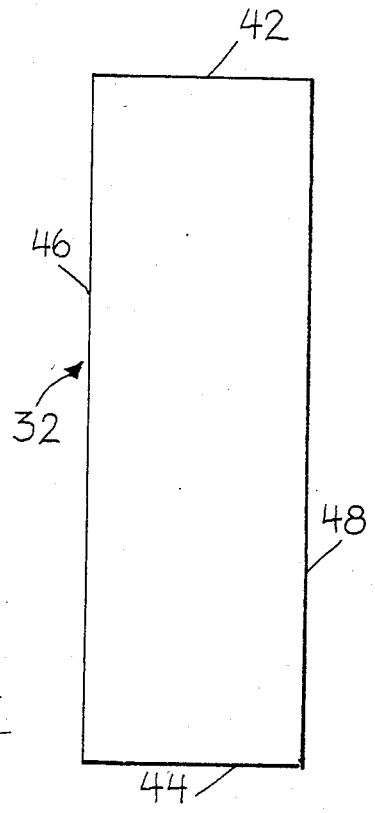
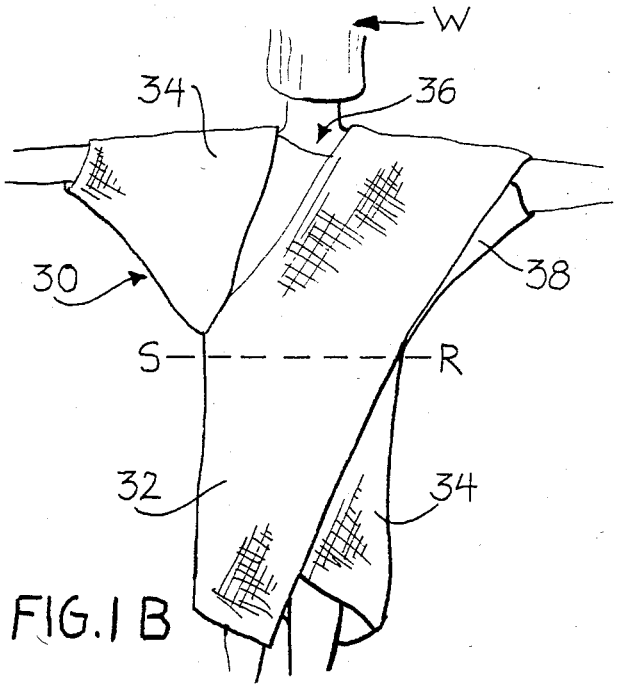
FIG. 1 B

GARMENTS EMPLOYING SUPERIMPOSED, DIAGONALLY-ORIENTED PANELS WITH FOLDED-BACK END PORTIONS

BACKGROUND—FIELD OF THE INVENTION

The present invention relates to the construction of garments, particularly to garments employing attached diagonal panels. The general term "garment" is used broadly to include dresses, jackets, coats, tunics, shirts, sweaters, blouses, and similar garments which cover at least the upper torso and arms of the wearer. For the convenience of disclosure, this variety of garments is subdivided into dress-type, blouse-type, and coat-type garments, each corresponding to a separate independent embodiment of the present invention. This invention is applicable to garments of all sizes for women, men, and children.

BACKGROUND—DESCRIPTION OF PRIOR ART

Present garments are usually constructed of many premeasured and specially-shaped different pieces of material, sewn together at their edges. This method of construction is extremely complicated, costly, and labor intensive because of numerous pieces of material required, the necessity of sewing them all together in a predetermined orientation, and the necessity of providing each piece in a wide variety of sizes. Moreover each piece usually has an irregular shape, including notches and cutouts, requiring the services of skilled pattern makers and cutters.

One attempted solution has been proposed in U.S. Pat. No. 4,301,546 to H. de Polo, issued Nov. 24, 1981. This patent discloses a pants-type garment comprising helically-wound and attached panels and side extension pieces. This garment, however, does not possess versatility, since it is intended generally for pants-type clothes and cannot be used for dresses, blouses, or coats. It is not suitable for economical mass production since its panels still consist of a plurality of separate elements and still have a complicated configuration with cutouts and notches. Also these panels are cut from a larger body of material, thus leaving waste, and must be shaped to accommodate different sizes of wearers. Furthermore, this type of garment cannot be easily adjusted for various sizes of wearers. Moreover, it is not attractive and is not useable with a variety of materials or fabrics; this is because trousers cannot always can be made of materials suitable for coats or blouses.

OBJECTS AND ADVANTAGES OF THE PRESENT INVENTION

Accordingly several objects of the present invention are to provide a garment construction which is economical, which does not require many different pieces, which does not require irregularly-shaped pieces, which does not require a large amount of labor to manufacture, which is versatile in that it can be used to produce dresses, blouses, or coats. The garment is suitable for economical mass production as it can be formed of at least two plain rectangularly-shaped pieces of material. The panels which are used for the construction of the garment of the invention can be cut without waste and without the need for cutouts or notches. The design and style of the garment of the invention allows it to be used with a wide variety of materials and fabrics, such as woven, knitted, felted, and laminated fabrics, leather, foils, plastics, etc. The garment of the invention is attractive and comfortable for the wearer. It can be easily adjusted for wearers of various sizes, and can be assembled from standard rolled materials of wide or narrow widths. Further objects and advantages of the present invention will become apparent from a consideration of the ensuing description and drawings.

BRIEF DESCRIPTION OF DRAWINGS

FIG. 1A is a general front view of a dress-type garment made in accordance with the present invention.

FIG. 1B is a general back view of a dress-type garment made in accordance with the present invention.

FIG. 2 is a plan view of a panel of material used for the production of the garment shown in FIG. 1.

DRESS-TYPE GARMENT—FIGS. 1-6

Figure 3:
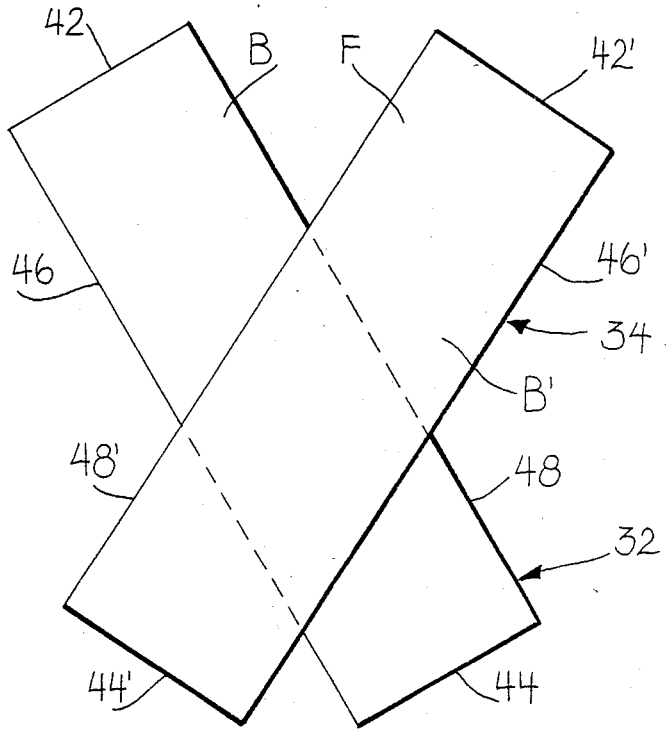
FIG. 3 is a view of two panels in a superimposed position.

A general front view of a dress-type garment made according to the invention is shown in FIG. 1, parts A and B. As shown in these figures, a dress-type garment, generally designated by reference numeral 30, has a very simple and at the same time aesthetic design. In the preferred embodiment shown in FIG. 1, it consists of two rectangularly-shaped elongated identical panels of material 32 and 34, one of which is shown in plan view of FIG. 2. Garment 30 has a neck opening 36, a sleeve opening 38, and a bottom opening 40. A wearer is designated by letter W.

FIG. 2 shows panel 32 which is identical to panel 34 (not shown in FIG. 2) and which has a rectangular shape. Each panel is defined by a minor, upper edge or end 42, a bottom, minor edge or end 44, an outer, major edge or end 46, and a major, inner edge 48.

Given below are the sequential steps of manufacturing garment 30.

First, two identical rectangular panels as shown in FIG. 2 are prepared. Since these panels are identical in shape and dimension, they can be simply cut sequentially from a roll of material of standard width (not shown). Similar edges of both panels 32 and 34 are designated by the same reference numerals but with addition of primes for panel 34. Letter F designates the front side of each panel, and letter B designates the back side of each panel.

First, one panel is placed over another in a face-to-face, or more correctly, a back-to-back, manner as shown in FIG. 3 so that back side B of underlying or bottom panel 32 contracts back side B' of overlying or top panel 34. Both panels are superimposed at a certain angle which can vary from 0° to 90°, but in one preferred embodiment the angle is about 60° so that the panels cross diagonally to form an "X".

Figure 4:
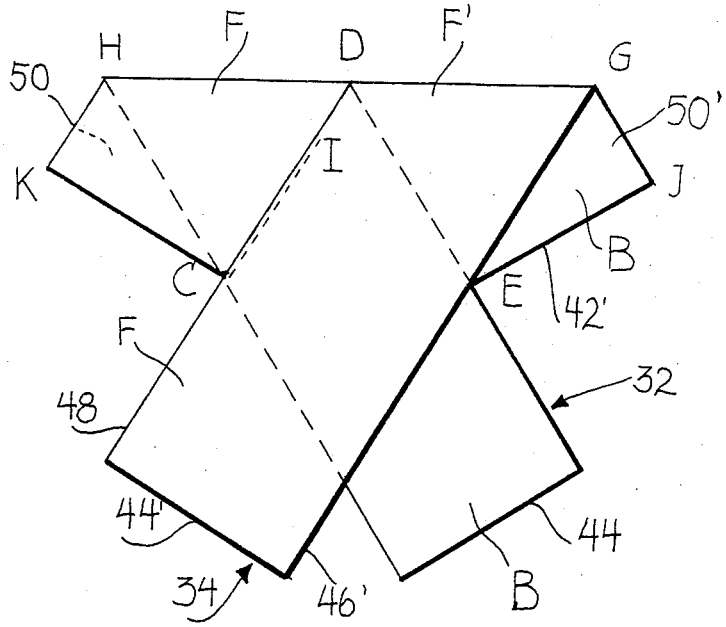
FIG. 4 is a view similar to FIG. 3 in which the upper portions of both panels are turned back.

Then, as shown in FIG. 4, an upper portion of each panel 32 and 34 is turned back angularly with respect to the main direction of each panel so as to form, after turning or folding, triangularly-shaped sleeve portions 50 and 50'. Preferably these upper portions may have a length of from 1/5 to ½ of the entire length of the panel. The panels are turned back or folded so that (1) a portion of the outer edges 48' of top panel 34 adjoins the outer edge of the folded-forward, upper portion of underlying panel 32 from point C to point D, and (2) a portion of outer edge 48 of bottom panel 32 adjoins the outer edge of the folded-back, upper portion of top panel 34 from point D to point E (broken line). At the same time, fold lines HD and DG, formed respectively on panels 32 and 34 when their upper portions are turned back, are aligned and form one continuous fold line GH. The angle between the fold line formed by turning back the upper portion of each panel and outer edge of such panel can vary from 90° to 160°.

Now panels 32 and 34 can be attached to each other, e.g. by a stitched seam, as shown by broken line 35 slightly displaced inwardly from line IC. A portion DI is left unstitched to provide an opening 36 (FIG. 1) which is used for the wearer's neck.

Figure 5:
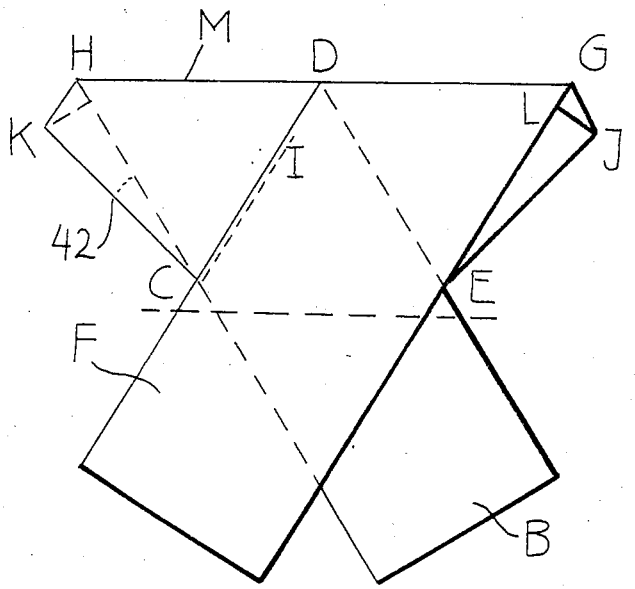
FIG. 5 is a view similar to that of FIG. 4 in which sleeve portions with sleeve openings are formed.

Sleeve portions 50 and 50' are then turned over toward inner edges 48 and 48', respectively, so that their edges EJ and KC adjoin the respective inner edges of panels 34 and 32. As a result, the semifinished product shown in FIG. 5 is obtained. The folded triangularly-shaped sleeve portions may be attached to corresponding inner edges 48 and 48' along the lines of coincidence EL and CM, or they can be attached at least at points L and M to the remaining parts of the semifinished garment. In FIG. 5 the attachment is shown in the form of stitches indicated by broken lines slightly displaced from lines CD and EG, respectively.

Figure 6:
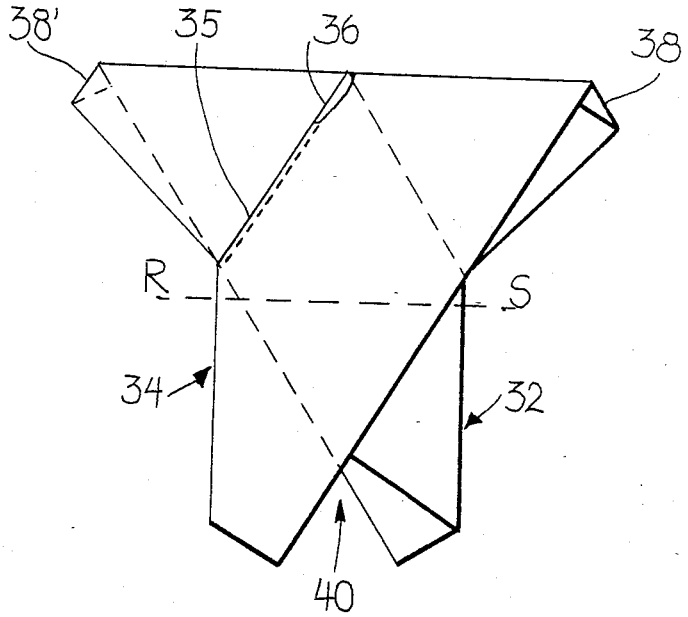
FIG. 6 is a general view of a completed dress-type garment.

To complete the garment, it is necessary only to turn over or fold lower portions of each panel toward the inner side of the other panel so that the inner side of one panel adjoins with and is attached to the outer side of the other panel. As a result, the finished garment shown in FIG. 6 is obtained. The garment shown in FIG. 6 has a neck opening 36, sleeve openings 38 and 38', and a bottom opening 40.

In the illustrated dress-type version, all attachments were shown as made by stitching. However, a person skilled in the art will understand that the seams are shown only for illustrative purposes and any other types of attachments can be used for this purpose. For example, edges can be connected by zippers, hooks and eyes, buttons, snaps, multiple hook-and-eyelet fasteners, etc.

BLOUSE-TYPE GARMENT—FIGS. 7 to 10

Figure 7:
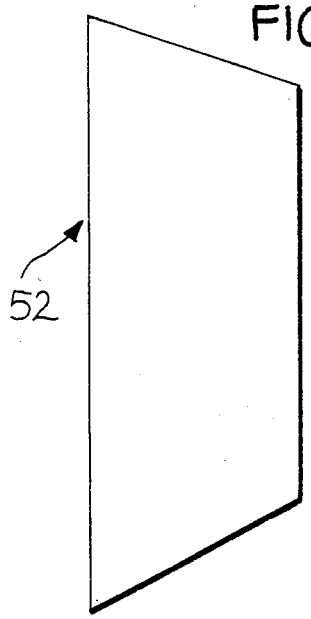
FIG. 7 is a view of a trapezoidally-shaped panel used for forming the blouse shown in FIG. 6.
Figure 8:
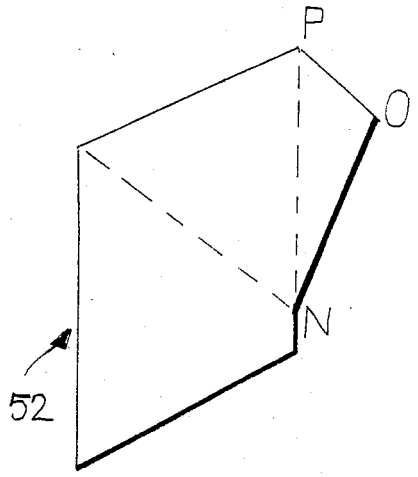
FIG. 8 is a view of a panel of FIG. 7 with the upper portion turned back.
Figure 9:
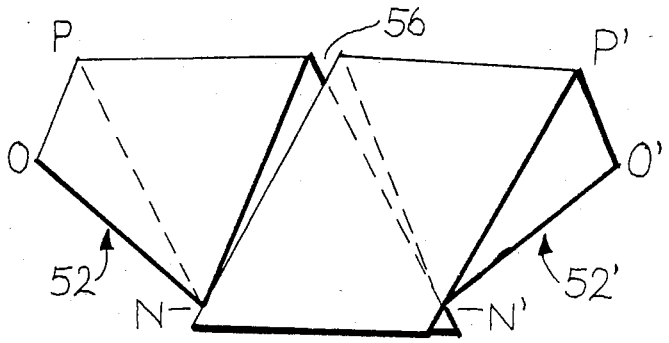
FIG. 9 is a view showing trapezoidal panels in a superimposed position.

The principle of the present invention can be applied to a blouse-type garment. The blouse is made of two trapezoidally-shaped panels which are similar in shape and dimension. Therefore only one of them (52) is shown in FIG. 7. Similar to the previous embodiment of the invention, the upper portion of each panel is first turned back to a position shown in FIG. 8 whereby a triangular portion NOP is formed. In FIG. 9 both panels are shown in superimposed position. This step does not require detailed explanation since it is identical to the similar operations performed with regard to the formation of a dress-type garment of FIG. 1.

Figure 10:
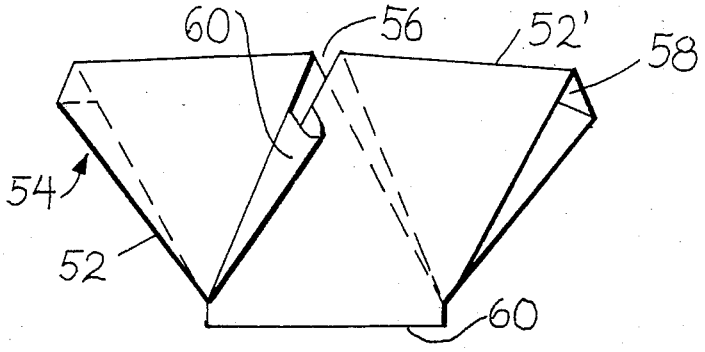
FIG. 10 is a completed blouse with a wedge-shaped insert.

The first panel is designated by reference numeral 52 and the second panel is designated by reference numeral 52'. The resultant finished blouse is shown in FIG. 10.

In fact it is equivalent to an upper part of the dress of FIGS. 1 or 6 cut along line RS. The lines of attachments are the same as in FIGS. 1 and 6.

The blouse, which is designated generally by a reference numeral 54, has a neck opening 56, a sleeve opening 58, and a bottom opening 60.

The blouse is provided with a wedge-shaped insert 62. This insert can also be used with any other garment of the present invention and it is shown in the blouse version for illustrative purpose only. Wedge insert 62 is used as a means for adjusting the size of the garment, as well as for providing a decorative detail. Wedge-shaped insert 62 does not change the relative positions of any elements of the blouse, but merely increases the volume of the garment. In other words, insert 62 can be used to adjust the size of the garment. The sides of wedge-shaped insert 62 are stiched to abutting inner edges 64 and 66 of of both trapezoidally-shaped panels 52 and 52'.

GARMENT WITH SIDE INSERTS—FIGS. 11 to 15

FIGS. 11 to 15 shows an embodiment of the present invention for use with material having a narrow width. Narrow panels are broadened in this embodiment by the use of side inserts. It is understood that the same principle of broadening panel width can be used with a garment of any type, e.g., dresses, blouses, jackets, or coats. type.

Figure 11:
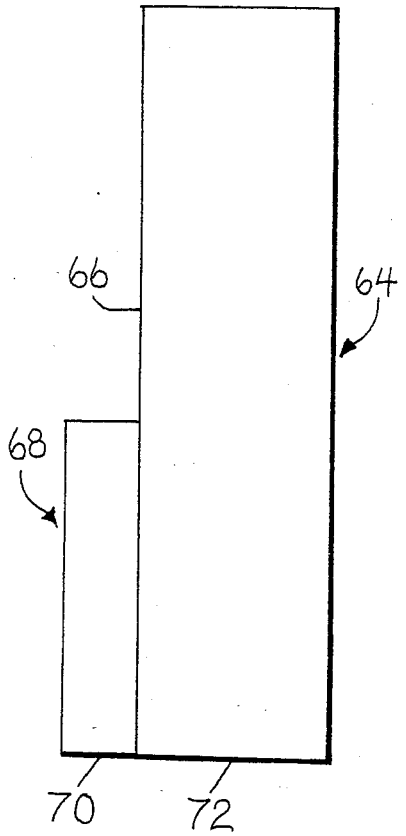
FIG. 11 is a view of a panel with an attached side insert.

FIG. 11 shows a panel 64 having an outer edge 66 to which a side insert 68 is attached. A lower edge 70 of side insert 68 is aligned with a lower edge 72 of panel 64 so that they form a continuous line. Side insert 68 is shorter in height than panel 64. Its length may vary within the range, preferably, of from ⅓ to ⅔ of the length of panel 64. Two identical pairs of panels with side inserts are used for the formation of a garment.

Figure 12:
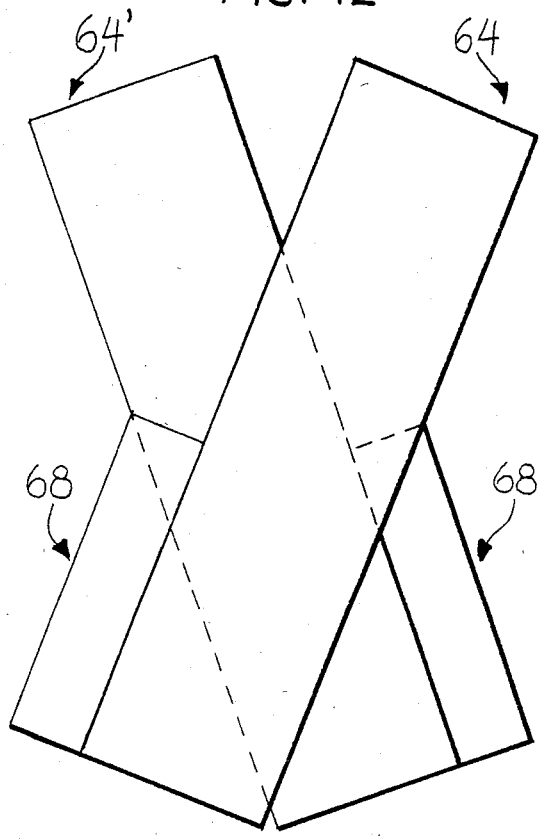
FIG. 12 is a view of two panels with side inserts in a superimposed position.
Figure 13:
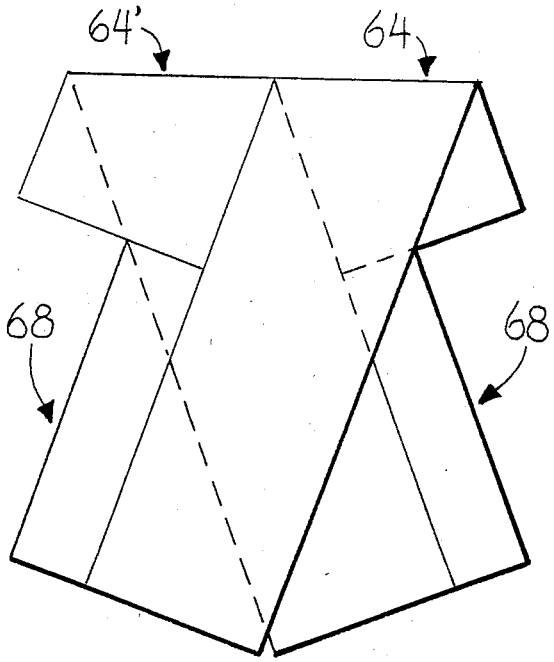
FIG. 13 is a view similar to FIG. 12 in which upper portions of panels are shown in a turned back positions.
Figure 14:
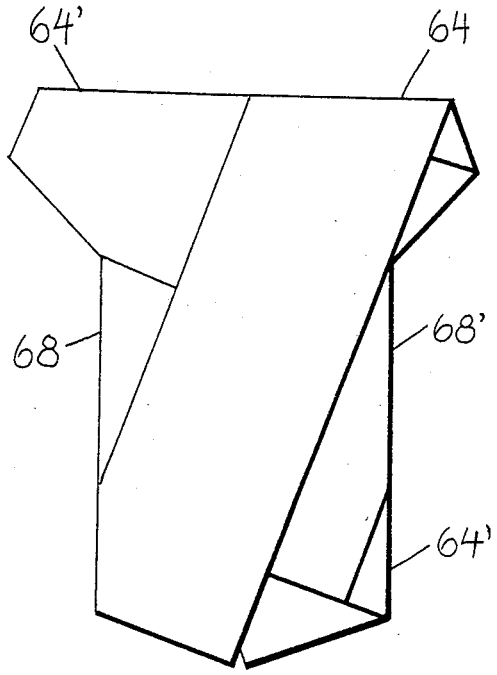
FIG. 14 is a completed garment composed of thin panels with side inserts.

Panels with side inserts are superimposed, turned back, and attached to each other in the same manner as has been described with reference to all previous embodiments of the present invention. FIG. 12 shows panels with side inserts in a superimposed position, FIG. 13 illustrates a semifinished product after turning back the upper sides of both panels, and FIG. 14 illustrates a completed garment made of panels with side inserts.

Figure 15:
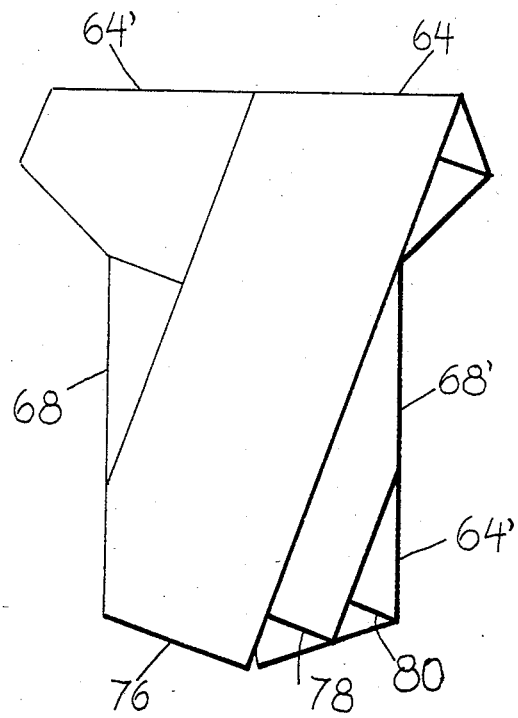
FIG. 15 is a view of a garment similar to FIG. 14 wherein each panel is composed of bands of different length.

Inserts and panel may have lower edges located at different levels, e.g. in a staggered fashion. This version is illustrated in FIG. 15. Lower edge 76 of one panel 64 is located below lower edge 78 of side insert 68'. Lower edge 78 of side insert 68, in turn, is located below the lower edge 80 of another panel 64'. This embodiment enables utility to be combined with an aesthetic effect, especially when only panels of different lengths are available. With a variety of such panels, it is possible to match the color, widths and lengths of different panels and inserts.

COAT-TYPE GARMENT—FIGS. 16 AND 17

Figure 16:
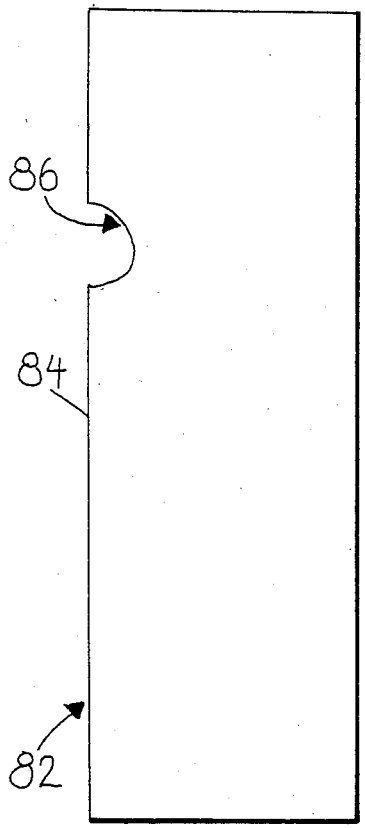
FIG. 16 is a view of a panel with a semicircular recess.
Figure 17:
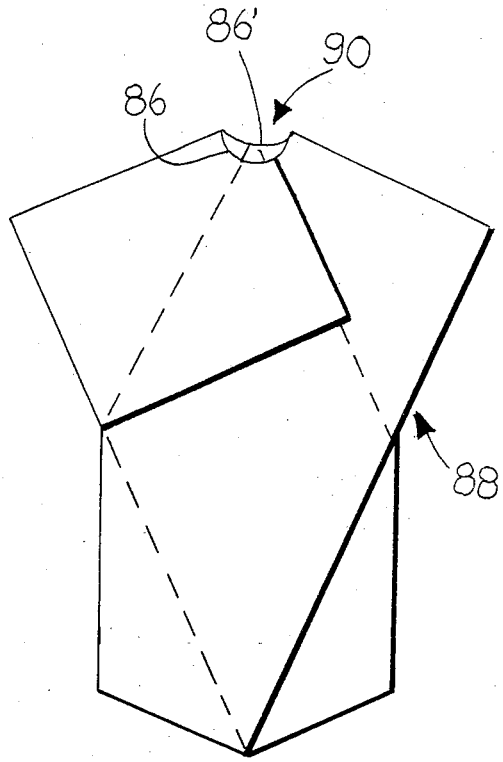
FIG. 17 is a coat-type garment.

FIGS. 16 and 17 illustrate a coat-type garment. The garment is constructed in the similar manner as the dress-type version disclosed in FIGS. 1–6. However, in this case a panel 82 shown in FIG. 16 is provided on its outer side 84 with a cemicircular recess 86 located at the level of the first fold formed by turining back the upper part of the panel. As a result, when two identical panels are superimposed onto each other and the garment 88 shown in FIG. 17 is formed in a fashion described above, semicircular recesses 86 and 86' define a neck opening 90.

Thus it is seen that the garment of the invention overcomes the drawbacks of the prior art by eliminating the need for cloth panels of complex shapes with their attendant high skilled labor cost, high sewing labor cost, fabric waste, lack of style and size versatility, difficulty of mass production, incompatability with a wide variety of materials, etc.

The invention has been described in connection with dress, blouse, and coat-type garments. It is obvious, however, that many other modifications of garments with bottom, sleeve, and neck openings employing diagonally-aligned panels are possible. Garments can be made in the form of jackets, kimonos, tunics, shirts, sweaters, etc. The neck opening may have a triangular shape or a rectangular shape. The diagonal superposition may be in a helically-opposite direction to that shown. False or real pockets can be utilized in various locations in combination with directions of stripes or grain on the material of the garment. More than two inserts, as well as more than one wedge-shaped insert, can be used. Therefore the scope of the invention should be determined, not by the examples given, but by the appended claims and their legal equivalents.

What I claim is:

1. A garment with bottom, sleeve, and neck openings and employing diagonally-oriented panels comprising: first and second elongated panels of material, said panels being superimposed and oriented so that their directions of elongation form an angle, each panel being defined by upper and lower minor edges and outer and inner major edges, the upper end portion of each panel, including said upper edge of each, being turned back angularly with respect to the direction of elongation of said panel so that the outer edge of each upper end portion of each panel adjoins a part of the outer edge of the other panel; and means attaching said adjoining edges, at least in part, together.

2. A garment according to claim 1 wherein a bottom portion of each panel is folded at an angle to its direction of elongation so that the outer edge of said bottom portion adjoins a part of the inner edge of the other panel, and further including means for attaching said outer edges of said bottom portions, at least in part, to the adjoining part of the inner edge of the other panel.

3. A garment according to claim 1 wherein said turned-over edges adjoin said inner major edges and are attached along said adjoining line at least for a part of the length of said line, said inner major edge of said turned-back upper portion of one of said panels adjoining said inner major edge of said second panel.

4. A garment according to claim 1 wherein said angle formed by said directions of elongation of said panels ranges from 0° to 90°.

5. A garment according to claim 1 wherein said attachment means are selected from the group consisting of stitches, zippers, buttons, multiple-hook-and-eyelet fasteners, snaps, individual hooks and eyelets, and ties.

6. A garment according to claim 1 wherein the length of said upper portions is from 1/5 to ½ of the entire length of said panel.

7. A garment according to claim 1 wherein the angle between a fold formed by said turning of said upper portion and said outer edge of said panel ranges between 90° and 160°.

8. A garment according to claim 1 wherein at least one of said panels is provided with a triangularly shaped wedge insert attached to said inner major edge of said one panel, said attachment extending from a point which is below the uper point of said neck opening to said inner major edge of said second panel, whereby said garment's size can be adjusted while simultaneously enhancing said garment's aesthetic effect.

9. A garment according to claim 1 wherein said panels take the form of identical trapezoids, the base of each of which is equal to the entire length of said inner major edges and the top side of said trapezoids is shorter than said outer major edges of said panels.

10. A garment according to claim 1 wherein fold lines formed by turning said panels back define one continuous horizontal line.

11. A garment with bottom, sleeve, and neck openings and employing diagonally-oriented panels comprising: first and second elongated panels of material, said first and said second panels being superimposed in a face-to-face manner so that their directions of elongation form an angle, each of said panels being defined by upper and lower edges and outer and inner edges, each of said inner edges having a semicircular recess, said panels being mutually oriented and attached so that said recesses combine to form a neck opening which has one continuous curved edge, an upper portion of each of said panels being folded so that the outer edge of said upper portion of each of said panels adjoins a part of said outer edge of said lower portion, whereby a pair of sleeve openings are formed.

12. A garment according to claim 11 wherein a part of said upper portion overlaps the outer edge of said panel; and having means for attaching said overlapped portion to said outer panel along said inner edge of said other panel, a lower portion of each of said panels being turned over so that said inner edge of one panel coincides with and is attached to said outer edge of another panel.

13. A garment according to claim 11 wherein said sleeve opening is partially closed along said outer edge of each panel from the point of intersection between said inner edge of one panel and said outer edge of said other panel to a point located within the range of from ¼ to ½ of the distance to the folding which is formed when said panels are turned back.

14. A garment according to claim 11 wherein said angle at which said panels are superimposed ranges from 15° to 30°.

15. A garment according to claim 13 wherein said attachment means are selected from the group consisting of stitches, zippers, buttons, multiple-hook-and-eyelet fasteners, including hooks and eyelets, and ties.

16. A garment according to claim 13 wherein said upper portion has a length of from $\frac{1}{8}$ to $\frac{1}{2}$ of the length of said panel.

17. A garment for covering the torso of a wearer, said garment being made of panels of material which are simple in shape and easy to fabricate, said garment comprising:

first and second elongated rectangular panels of material which, when worn by said wearer, overly the front and back sides of said wearer, respectively, said first panel being oriented so that its direction of elongation is at an angle to the direction of elongation of said wearer, and so that one end thereof extends around one shoulder of and partially down the back of said wearer so that the other end thereof extends around a lower portion of said side of wearer opposite to said one shoulder, said second panel being oriented so that its direction of elongation is at an angle to the direction of elongation of said wearer and to said first panel so that it forms an "X" with said first panel when said wearer is viewed from the front or back, one end thereof extending around the other shoulder and partially down the front of said wearer and so that the other end thereof extends around a lower portion of the side of said wearer opposite to said other shoulder, the part of each of said panels which extends around the shoulder of said wearer being attached to the other panel, and the part of each of said panels which extends around the lower portion of said wearer being attached to the other panel.

18. A garment according to claim 17 wherein said panels are made of fabric having stripes inclined to said direction of elongation at an angle ranging from 0° to 90°.

19. A garment according to claim 17 wherein a neck cutout is formed in each of said panels, said neck cutouts being oriented so that they match when said panels are assembled.

* * * * *